US011085218B2

(12) United States Patent
Herper et al.

(10) Patent No.: US 11,085,218 B2
(45) Date of Patent: Aug. 10, 2021

(54) DEVICE FOR MOVING A FURNITURE FLAP AND PIECE OF FURNITURE

(71) Applicant: Grass GmbH, Reinheim (DE)

(72) Inventors: Markus Herper, Muehltal (DE); Boris Kruedener, Kleinostheim (DE)

(73) Assignee: Grass GmbH, Reinheim (DE)

( * ) Notice: Subject to any disclaimer, the term of this patent is extended or adjusted under 35 U.S.C. 154(b) by 0 days.

(21) Appl. No.: 16/729,837

(22) Filed: Dec. 30, 2019

(65) Prior Publication Data

US 2020/0217117 A1 Jul. 9, 2020

(30) Foreign Application Priority Data

Jan. 7, 2019 (DE) ..... 10 2019 100 188.9

(51) Int. Cl.
*E05D 3/06* (2006.01)
*E05F 1/12* (2006.01)

(52) U.S. Cl.
CPC ..... *E05F 1/1246* (2013.01); *E05Y 2900/20* (2013.01)

(58) Field of Classification Search
CPC ..... E05F 1/1246
See application file for complete search history.

(56) References Cited

U.S. PATENT DOCUMENTS 7,178,202 B2 * 2/2007 Hirtsiefer ..... E05F 1/1261 16/366
7,500,287 B2 * 3/2009 Brustle ..... E05F 1/1075 16/286
7,707,687 B2 * 5/2010 Giovannetti ..... E05D 15/262 16/289
8,082,629 B2 * 12/2011 Migli ..... E05F 1/1091 16/366

(Continued)

FOREIGN PATENT DOCUMENTS

AT 511 546 A1 12/2012
DE 199 43 280 C1 1/2001

(Continued)

OTHER PUBLICATIONS

European Search Report (Application No. 19218419.0) dated May 7, 2020.

(Continued)

*Primary Examiner* — Jason W San
(74) *Attorney, Agent, or Firm* — Burr & Brown, PLLC

(57) ABSTRACT

A device is proposed for moving a furniture flap received on a furniture body of a piece of furniture having a spring-force unit, which assists the opening and/or the closing of the furniture flap by a predetermined force action of the spring-force unit via an adjusting arm engaging with the furniture flap in the mounted state. According to the invention, an electrically switchable adjusting unit is provided, which is coupled to the spring-force unit in such a way that a movement of the spring-force unit into a predetermined (Continued)

adjustment position of the spring-force unit on the piece of furniture occurs by a switching of the adjusting unit in the mounted state of the device so that a degree of force action of the spring-force unit on the furniture flap can be adjusted in dependence on the adjustment position of the spring-force unit.

11 Claims, 2 Drawing Sheets

(56) References Cited

U.S. PATENT DOCUMENTS 8,321,996 B2 * 12/2012 Hirtsiefer ..... E05D 15/46 16/286
8,468,653 B2 * 6/2013 Tumler ..... E05D 15/46 16/286
8,590,990 B2 * 11/2013 Friesenecker ..... E05F 15/63 312/319.6
9,926,734 B2 * 3/2018 Dora ..... E05F 15/616
10,876,336 B2 * 12/2020 Kruedener ..... E05D 11/10
2002/0166208 A1 * 11/2002 Kondo ..... E05F 1/1215 16/289
2004/0172787 A1 * 9/2004 Collene ..... F24C 15/023 16/289
2010/0162847 A1 * 7/2010 Gassner ..... E05F 1/1058 74/490.07
2012/0079684 A1 * 4/2012 Tumler ..... E05D 15/463 16/277
2013/0214663 A1 * 8/2013 Marzorati ..... A47B 96/00 312/400
2015/0096147 A1 * 4/2015 Rohner ..... E05D 3/12 16/233
2015/0096148 A1 * 4/2015 Gherardi ..... E05D 11/08 16/289
2016/0073781 A1 * 3/2016 Herper ..... A47B 88/483 312/334.1
2016/0348919 A1 * 12/2016 Ivanovic ..... E05C 3/14
2017/0335611 A1 * 11/2017 Brunnmayr ..... E05D 7/00
2018/0087307 A1 * 3/2018 Hammerer ..... E05F 5/006
2018/0320425 A1 * 11/2018 Holm ..... E05D 7/085
2019/0003229 A1 * 1/2019 Brunnmayr ..... E05F 3/106
2019/0316394 A1 * 10/2019 Kruedener ..... E05F 1/1058
2019/0316395 A1 * 10/2019 Kruedener ..... E05D 3/06
2019/0316396 A1 * 10/2019 Kruedener ..... E05D 11/0054
2019/0316397 A1 * 10/2019 Kruedener ..... E05D 3/12
2019/0316398 A1 * 10/2019 Kruedener ..... E05D 3/06

FOREIGN PATENT DOCUMENTS

DE 20 2010 005 934 U1 9/2010
DE 20 2010 001 670 U1 7/2011
EP 2 191 089 B1 12/2012
WO 2011/011800 A2 2/2011

OTHER PUBLICATIONS

German Search Report (Application No. 10 2019 100 188.9) dated Dec. 5, 2019.

* cited by examiner

DEVICE FOR MOVING A FURNITURE FLAP AND PIECE OF FURNITURE

This application claims the benefit under 35 USC § 119(a)-(d) of German Application No. 10 2019 100 188.9 filed Jan. 7, 2019, the entirety of which is incorporated herein by reference.

FIELD OF THE INVENTION

The present invention relates to a device for moving a furniture flap and piece of furniture.

BACKGROUND OF THE INVENTION

Devices are known for the manual or hand-guided moving of a single-piece or multiple-piece furniture flap held on a furniture body of a piece of furniture, such as furniture flap fittings. Preferably, such a device comprises a swivel or a swivel arm arrangement with a swiveling adjustment arm, which can be connected to the furniture flap, for swiveling the furniture flap outward. In the mounted device, the furniture flap can be moved from a closed position on the furniture body to an open position relative to the furniture body and back. This is done by the manual movement of the furniture flap by an operator.

In order to assist the manual opening movement of the furniture flap and/or to maintain a resting position of the furniture flap in a partly or fully opened position on the furniture body, the device comprises, for example, a spring-force unit for providing a spring force or a tensile and/or compressive force. The spring-force unit acts in such a way, especially by the adjusting arm connected to the furniture flap, that the furniture flap can be easily opened without major exertion by the operator and does not drop uncontrolled in the other swivel direction when closing it, under the natural weight of the furniture flap.

In the case of relatively heavy or bulky furniture flaps, relatively larger forces or a corresponding relatively strong spring-force unit are needed, which is also noticeable during a manual closing of the opened furniture flap.

SUMMARY OF THE INVENTION

The object of the present invention is to improve a device as described at the outset in regard to a controlled and safe mode of operation and high user comfort, especially as regards the use in relatively heavy furniture flaps and their force-assisted manual or hand-guided movement.

The present invention starts from a device for moving a furniture flap received on a furniture body of a piece of furniture having a spring-force unit, especially a furniture flap fitting, wherein the spring-force unit assists the opening and/or the closing of the furniture flap by a predetermined force action of the spring-force unit via an adjusting arm engaging with the furniture flap in the mounted state of the device. The spring-force unit, such as a spring-force accumulator, is preferably attuned to the furniture flap in such a way that, in the fully opened position and in every possible partly opened swivel position on the furniture body between the fully closed and the fully opened position, the furniture flap is held in a balanced and safely resting state when an operator does not manually apply a force to the furniture flap, for example, does not pull or press on it. This occurs by an interplay of the natural weight of the furniture flap, the force action of the spring-force unit, which acts, in particular, like a movement guide or hinges of the swivel arm assembly against the force due to the natural weight of the furniture flap, and frictional effects of sections inside the device.

The spring-force unit preferably comprises at least one mechanical spring, such as a helical spring or, for example, a mechanical spring acting like a tension spring and/or compression spring.

The device preferably comprises at least one adjusting arm which acts like a lever, preferably multiple interacting or interconnected adjusting arms, which are arranged between the furniture body and the furniture flap and dictating the movement of the furniture flap.

The device is accordingly configured as a single-hinge or preferably a multiple-hinge assembly with spring-force unit or force accumulator.

As a rule, two identical devices according to the present invention for the swivel movement of the furniture flap are present between the furniture body and the furniture flap, at least one device has a spring-force unit, and preferably both devices have a spring-force unit.

The heart of the present invention is that an electrically switchable adjusting unit is provided, which is coupled to the spring-force unit in such a way that a movement of the spring-force unit into a predetermined adjustment position of the spring-force unit on the piece of furniture occurs by a switching of the adjusting unit or an electrical switching of the adjusting unit in the mounted state of the device so that a degree of the force action of the spring-force unit on the furniture flap can be adjusted in dependence on the adjustment position of the spring-force unit. This presupposes that the particular action of the spring-force unit is different from other respective or different adjustment positions of the spring-force unit. Hence, the spring-force unit can be moved and adjusted such that the force action of the spring-force unit is altered, preferably altered between different operating phases, in such a way that on the one hand the manual opening and on the other hand the manual closing of the furniture flap can be done conveniently by an operating person. In particular, the movement should be such that the action of the spring-force unit is strong enough for the safe opening and holding of the heavy furniture flap to be possible in a balanced way in every possible opening position and furthermore the closing is easy, without the person having to bear the substantial weight of the furniture flap.

During the closing, the operating person should be able to move the furniture flap with a reasonable effort, which can also be done readily by frail or elderly people or children.

It is advantageous and fundamental to the present invention that the electrically switchable adjusting unit does not need to be designed so strong as to perform the actual movement of the furniture flap. The force for moving the furniture flap is provided at least substantially or predominantly by the operating person through manual grasping of the furniture flap. The spring-force unit provides assistance in holding the major portion of the natural weight of the furniture flap. The switchable adjusting unit is preferably not active nor effective during the manual movement by the operating person. The adjusting unit between the opening and the closing or between movement phases of the furniture flap only acts on the position and thus dependently of the force action of the spring-force unit between the movement phases of the furniture flap and thus influences ahead of time the following force action of the spring-force unit on the moving furniture flap, because a stress state or a compression or tension force provided by the spring-force unit is dictated in dependence on the position of the spring-force unit.

The switchable adjusting unit, in particular, has nothing to do with a motion drive for the driven, e.g., motorized moving of a furniture flap in the opening and/or closing direction. Instead, the switchable adjusting unit as compared to a furniture flap motion drive can be designed with at least an order of magnitude less powerful, which is economically advantageous and advantageous in regard to space requirement.

A different degree of force action of the spring-force unit on the furniture flap results according to the adjustment position of the spring-force unit. The switching process for switching the adjusting unit occurs preferably when this is at standstill or, for example, in the almost or fully opened and almost or fully closed position of the furniture flap. In this case, the spring-force unit is shortly before or in a state of static action on the furniture flap.

The adjusting unit serves especially for changing the length of the spring which is clamped between two attachment points at opposite ends of the spring. At least one attachment point is moved by the adjusting unit for this purpose.

It is preferable for the movement to occur in such a way that the spring-force unit approximately compensates for the action of the natural weight of the furniture flap. In this way, the operating person does not feel the weight of the furniture flap during the manual moving of the furniture flap. The operating person does not need to use as much effort during the opening as would be needed without a spring-force unit, but instead only needs to use a fraction of this effort. Correspondingly, for the closing, one need basically only overcome the static friction briefly or allow for the effects of sliding friction. The major portion of the natural weight of the furniture flap is compensated by the action of the spring-force unit during the opening and closing.

Thus far, when the furniture flap is partially and especially fully open, one has had to work against the action, such as the maximum action of the spring-force unit, or to move the furniture flap against the action of the spring-force unit, which may mean a considerable effort, especially in the case of relatively heavy furniture flaps, since the corresponding force opposing the weight of the furniture flap is provided by the correspondingly strong spring-force unit against the closing direction when the furniture flap is open.

According to the present invention, the spring-force unit is preferably switched to move prior to the closing movement of the fully open furniture flap, for example, so that the action of the spring-force unit is somewhat withdrawn, as compared to the state during the opening process, before or at the beginning of the manual closing movement. The force action may be withdrawn in advance continuously, but also conceivably, for example, abruptly or during the closing movement of the furniture flap and/or adapted to the movement state. The attuning of the switchable adjusting unit is preferably controlled or dictated with a control unit such as a computer unit. The control unit serves, for example, for the programmable operation of the switchable adjusting unit.

Preferably, the spring-force unit is moved prior to the closing movement of the furniture flap so that the spring-force unit, as regards the situation prior to the movement process, in its force action on the furniture flap, exerts a reduced force action on the furniture flap, but is still not entirely free of action, for example, in order to provide the upward acting force of the spring-force unit as a force opposing the natural weight of the furniture flap. This prevents the furniture flap from swiveling or falling down uncontrolled when the operating person is not grasping the furniture flap, or not grasping it with sufficient force after the switching of the adjusting unit from a full action to a partial action of the spring-force unit.

Advantageously, the electrically switchable adjusting unit comprises an electric drive. In this way, the effective degree of the spring-force unit can be reproduced or set in an especially user-friendly and exact manner. The electric drive is preferably an electric motor, such as a servomotor.

Further, it is advantageous for a first force application site of the spring-force unit to be adapted for an attachment on the furniture body and for a second force application site of the spring-force unit to be adapted for an attachment on the furniture flap side, wherein the adjusting unit is provided for changing the distance between the first force application site of the spring-force unit and the second force application site of the spring-force unit. In this way, it is possible to change the state of the spring of the spring-force unit or its length, i.e., its effective tension and/or compression force.

The first force application site is preferably a section of a base unit of the device which is secured to the furniture body and to which one end of the swivel arm assembly or the adjusting arm is hinged. The second force application site is preferably present on the swivel arm assembly, for example, on a lever or swivel arm of the swivel arm assembly. The force application site may also be present on the adjusting arm or directly on the furniture flap.

The at least one spring of the spring-force unit is clamped, e.g., between the two force application sites of the spring-force unit. Preferably, the action of the second force application site on a portion of the swivel arm assembly connected to the adjusting arm or on the adjusting arm is such that the adjusting arm moves or swivels due to the action of the spring force so that the furniture flap is moved upward or experiences a force in the opening direction. The change in distance preferably occurs by a change in position at precisely one of the two force application sites, preferably the first force application site.

According to one advantageous variant of the present invention, the adjusting unit is provided for changing the position of the first force application site of the spring-force unit. Preferably, only precisely one or the first force application site is changed. In this way, the application site on the furniture body side is moved. This is advantageous in regard to the placement of the adjusting unit.

An alternative or additional arrangement whereby the position of the second force application site is changed with the adjusting unit, i.e., in the region of the application on the swivel arm assembly or on the adjusting arm or on the furniture flap, is not ruled out.

The adjusting unit may basically comprise exactly one electric motor, which is preferred, or it may comprise two or more electric motors.

Advantageously, the spring-force unit can be moved with the adjusting unit into at least two different adjustment positions. This is especially easy to arrange. In particular, it is arranged that the first force application site of the spring-force unit can be moved from a first adjustment position to another or second adjustment position and back to the first adjustment position. The second force application site preferably remains unchanged in this process. Thus, for example, a spring is lengthened as compared to its prior situation and this changes a compression or tension action of the spring-force unit on the furniture flap. The reversible movement means that the spring-force unit applies a larger force action or for example a maximum force action to the furniture flap during its opening, in one adjustment position of the spring-force unit, and a reduced or minimal force action prevails on the furniture flap during its closing, in the other adjustment position of the spring-force unit. The closing movement of the furniture flap is somewhat assisted by the natural weight of the furniture flap, but by the spring-force unit to a degree that the furniture flap does not drop unimpeded when the operating person releases the furniture flap. The furniture flap then remains standing balanced on account of the action of the spring-force unit and static friction effects. The spring-force unit and the adjusting unit are exactly attuned for this purpose.

A further advantage is that the adjusting unit is designed to reversibly move the spring-force unit with the adjusting unit into at least two different adjustment positions. In this way, each opening process of the furniture flap can always take place with the same increased force assistance from the spring-force unit and each closing process can always take place with the same, but reduced force action by the spring-force unit. Starting from the closed position of the furniture flap, in which the adjusting unit organizes a first adjustment position with a greater degree of force action, the opening movement by the operating person is optimally assisted at higher force action by the spring-force unit, for example, after releasing the locking. The opening is easily possible for the operating person, since the person himself must ideally overcome frictional resistances or only exert a slight force to move the furniture flap upward. After reaching the opening position of the furniture flap, which can be dictated e.g. by a mechanical stop, the adjusting unit sets the second adjustment position, whereby the degree of force action of the spring-force unit is less in the opening direction. Thus, it is likewise easy for the operating person to close the furniture flap with a slight effort. The spring-force unit only applies enough force to basically take up the weight of the furniture flap. Then, when the furniture flap is closed, the adjusting unit sets the spring-force unit once more, i.e. reversibly, in the previous or first adjustment position and so forth.

It is furthermore advantageous for the adjusting unit to be adapted to move the first force application site of the spring-force unit in a direction away from the second force application site of the spring-force unit. Consequently, a force acting on the furniture flap in the opening direction or the degree of force action of the spring-force unit on the furniture flap is decreased solely by the length of the spring. The adjustment in this regard occurs especially with the furniture flap open. A corresponding return movement in the other direction by the same distance occurs preferably with the furniture flap closed. Then the compression force acting from the adjusting arm on the furniture flap is again increased or the spring-force unit is again more strongly pretensioned for the next opening process.

It is further proposed that the adjusting unit is adapted to operate a locking mechanism for the locking of the furniture flap in the closed position on the furniture body. In this way, the furniture flap can be locked in electrical or switchable electrical manner. Thanks to the locking, the furniture flap is prevented from opening by itself or spontaneously without conscious releasing from the outside, e.g., because of the force action of the spring-force unit. Preferably, therefore, in the locked state the spring-force unit is in an adjustment position, in which a relatively large degree of force action of the spring-force unit on the furniture flap is provided. But this is unproblematic as regards the safe closing situation of the furniture flap, since the locking mechanism prevents the closed furniture flap from opening, e.g., unintentionally or spontaneously under the action of the spring-force unit. The action on the locking mechanism preferably occurs immediately after the furniture flap has reached the closed position and before the movement of the spring-force unit occurs by the adjusting unit with the furniture flap closed.

It is furthermore preferable for the spring-force unit to have a spring-force pack with a spring-force accumulator. With a spring-force pack having at least one spring-force accumulator, for example, a helical, compression, or tension spring, with a spring-force pack composed preferably of multiple separate spring-force accumulators, a sufficiently large force can always be provided, attuned to the weight of the particular furniture flap, in order to open the furniture flap or compensate for the weight of the furniture flap. The two or three or more springs which can be pretensioned to different degrees with the adjusting unit, for example, form the force accumulator. The spring-force pack is determined in its maximum force by the number of spring-force accumulators used. The multiple spring-force accumulators, for example, can be adjusted together with the adjusting unit, for example, by moving an attachment element to which all springs of the spring-force accumulator are mutually attached.

The present invention furthermore relates to a piece of furniture having a device according to one of the above explained embodiments. In this way, a piece of furniture regardless of whether a heavy or a light furniture flap is present can be advantageously and comfortably moved manually, adapted to the situation. A comparatively small and economical adjusting unit is sufficient for this, such as, for example, an electric motor or a servomotor.

BRIEF DESCRIPTION OF THE DRAWINGS

Further features and benefits of the present invention are explained more closely with the aid of exemplary embodiments represented schematically in the figures.

DETAILED DESCRIPTION OF THE INVENTION

Figure 1:
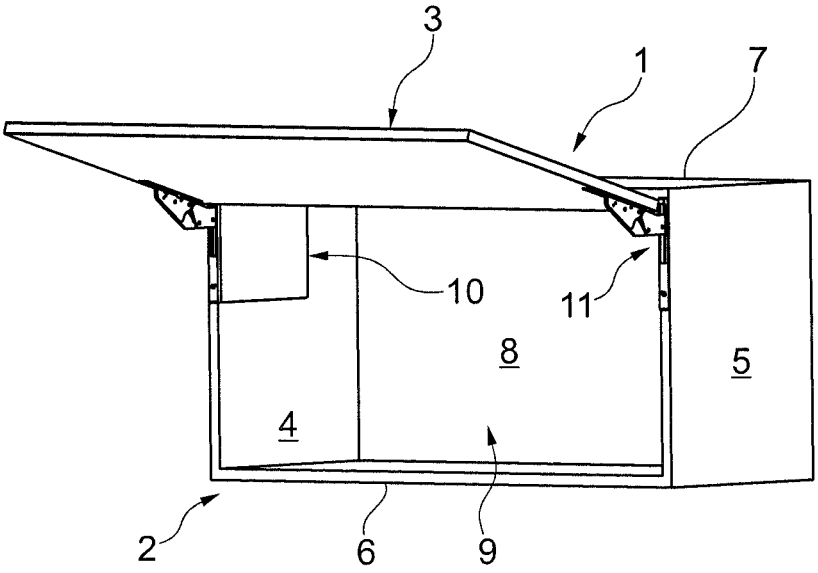
FIG. 1 shows a perspective diagonal view from above of a piece of furniture according to the present invention with a device according to the present invention for moving a furniture flap of the piece of furniture, shown opened.

FIG. 1 shows in perspective view a piece of furniture or an upper cabinet 1 according to the present invention with a boxlike furniture body 2 and a furniture flap received thereon, fashioned as a platelike top flap 3, which is shown in an open position or opened on the furniture body 2 and relative to the furniture body 2.

The furniture body 2 comprises two mutually facing upright side walls 4 and 5, which are joined at the bottom to a bottom panel 6 and at the top to a top panel 7. At the back, the furniture body 2 is closed by a rear wall 8.

In order to move the top flap 3 about a horizontal swivel axis relative to the furniture body 2 from the open position shown in FIG. 1 to a closed position moved toward the front of the furniture body 2 (see FIGS. 3 and 7) and back, a movement device according to the present invention is present, designed as a top flap fitting 9. The top flap fitting 9 comprises a first fitting unit 10 on the side wall 4 and a second fitting unit 11 on the side wall 5, which are built identically on the sides but situated for their functional arrangement on the respective side wall 4 or 5.

Each fitting unit 10 and 11 comprises a base unit 12 with a cover plate 14, a swivel arm assembly 13 having an adjusting arm 13*a* (see FIG. 5), and a mounting unit 15. The base unit 12 is connected to the mounting unit 15 by multiple hinged swivel arms of the swivel arm assembly 13 and fastened firmly to an inside of the top flap 3, e.g., countersunk in a material recess of the top flap 3.

Moreover, the base unit 12 comprises a spring-force unit 16 for assisting the opening movement of the top flap 3 into the open position and back to the closed position.

Figure 5:
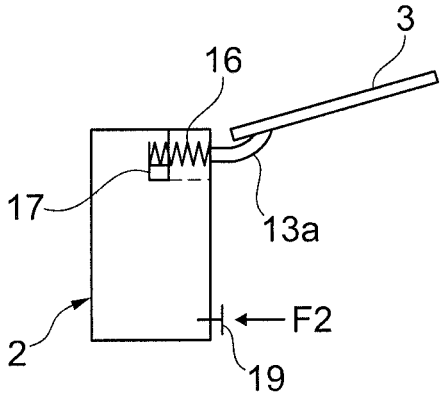

An end position bumper (not shown) can be provided, making possible a dampened closing movement of the top flap 3 into the closed position or into an upper end position of the top flap 3 as per FIG. 5.

Figure 2:
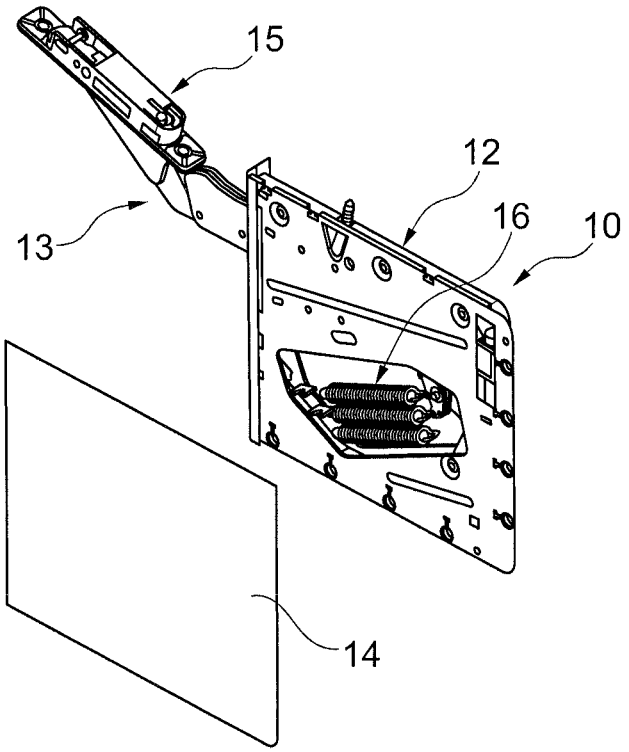
FIG. 2 shows a perspective represented device according to the present invention with a cover plate raised from a base unit.

An electrically switchable adjusting unit of the fitting unit 10, drawing electric power from an electrical power supply, is not visible in FIG. 2.

Figure 3:
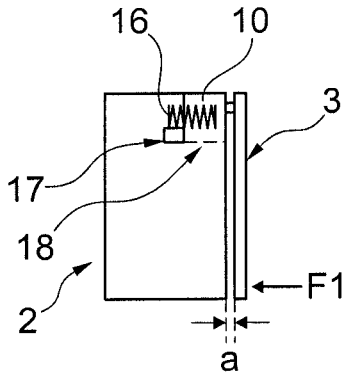
FIGS. 3-7 show a piece of furniture as per FIG. 1, highly schematized and with indicated spring-force unit of the device in different operating states, each time from the side.

According to FIG. 3, the top flap 3 is swiveled toward the end or front side of the furniture body 2 and is at rest in this closed position, locked by a releasable locking mechanism 18, not shown.

Between a flat level inside of the closed and locked top flap 3 and an end or front side of the furniture body 2 there is formed a spacing according to a closed gap or air gap a. The closed or air gap may be relatively narrow, for example, a few millimeters.

For the opening of the top flap 3, a mechanical releasing occurs, for example, by hand or by hand pressure from the outside on the top flap 3 according to the force F1 in the direction of the front or end side of the furniture body 2.

The top flap 3 moves toward the furniture body 2, which is possible because of the closed gap a. The locking mechanism 18 is preferably mechanically released, so that a locking of the closed top flap 3 is canceled.

Alternatively, an electrical releasing and locking of the locking mechanism 18 is possible. However, the subsequent opening of the top flap 3 is possible without energy, or it occurs without an electric drive. The opening or upward swivel movement of the top flap 3 per P1 occurs advantageously without energy or by the mechanical force action of the spring-force unit 16 entirely by itself or the spring-force unit 16 serves at least as an assist for the manual movement of the top flap 3, with the operating person grasping the top flap 3 by hand, for example, at a bottom edge or a handle on the top flap 3, not represented.

Figure 4:
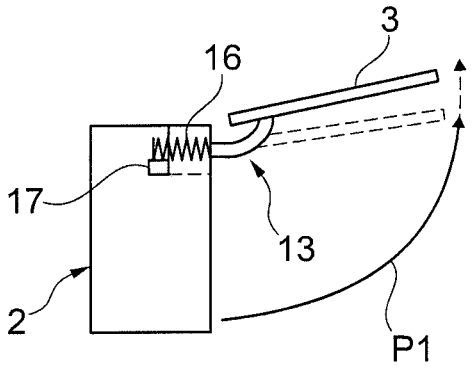

FIG. 4 indicates the mechanical or manual opening movement P1 having occurred and shows the completely opened top flap 3 in the upper end position, indicating by broken line a held, not fully opened intermediate position of the top flap 3. This is reached, e.g., if the operating person does not move the top flap 3 further upward or releases it before reaching the end position with the top flap 3 fully opened relative to the furniture body 2 (see FIGS. 4 and 5). The spring-force unit 16 forms the force opposing the weight of the top flap 3.

The end position can be changed, for example, by an angle or swivel stop (not shown).

In the fully opened and resting end position of the top flap 3 (see FIG. 5), a releasing element 19 present, for example, or preferably on the furniture body is manually activated or activated by hand with the force F2. The releasing element 19 is provided for the switching of an electrically switchable adjusting unit 17 and is connected to the adjusting unit 17 or communicates with it. For this purpose, the releasing element 19 comprises a wireless, wired, and/or mechanical connection to the adjusting unit 17. The activating of the releasing element 19, such as, for example, a pushbutton, a switch, or a sensor, initiates the closing process or is the precondition for the manual closing of the top flap 3.

Figure 6:
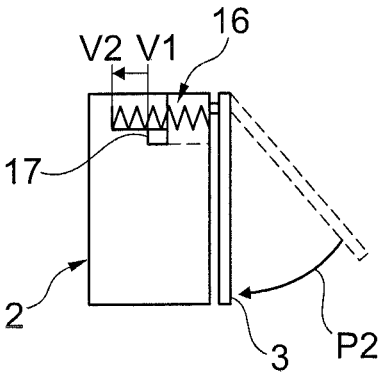

The activating of the releasing element 19 or the switching of the adjusting unit 17 coupled to the spring-force unit 16 results in a moving of the spring-force unit 16 from one present adjustment position V1 to another predeterminable adjustment position V2, as indicated by FIG. 6.

For the closing of the top flap 3, a first force application site of the spring-force unit 16 such as the force application site on the furniture body side is moved from a first adjustment position V1 to a second adjustment position V2.

Figure 7:
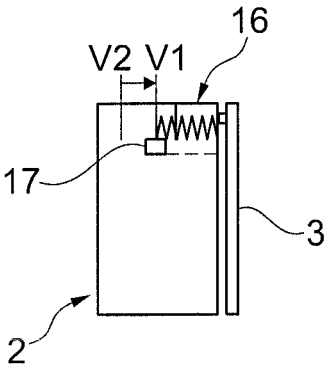

In this way, a degree of force action of the spring-force unit 16 on the top flap 3 is altered or reduced, so that the top flap 3 either swivels downward spontaneously and slowly under its natural weight in balanced manner into the closed position per FIG. 6 and FIG. 7, or the top flap 3 stays in the upper end position until an operating person manually grasps the top flap 3 and swivels it downward, under relatively slight effort, into the closed position of FIG. 7.

After reaching the closed position of the top flap 3, the adjusting unit 17 continues onward and activates the locking mechanism 18 or blocks the top flap 3. Thus, in the closed position, the top flap 3 is held at rest and locked by the locking mechanism 18.

The energy requirement is advantageously relatively slight, since the weight of the top flap is used for assistance in the closing. In comparison somewhat more energy is needed, however, for the tensioning of the locking mechanism 18.

Now the force application site on the furniture body side is moved from the second adjustment position V2 back to the first adjustment position V1, for example, assisted by the adjusting unit 17, until the spring-force unit 16 is again more strongly pretensioned according to the condition of FIG. 3 (see FIG. 7).

Even if the spring-force unit 16 or its abutment on the furniture body 2 remains in the adjustment position V2 with the top flap 3 closed, the top flap 3 can be swiveled upward or opened by hand or manually, which is of advantage in event of a power outage.

Advantageously, the time window for tensioning the spring-force unit 16 or the moving of the force application site on the furniture body side from the second adjustment position V2 to the first adjustment position V1 is larger than the opening movement of the top flap 3.

The larger this time window, the less energy required for the movement from V2 to V1.

The time window for tensioning the spring-force unit 16 or the moving from the adjustment position V2 to the adjustment position V1 is advantageously independent of the opening and closing process.

LIST OF REFERENCE NUMBERS

1 Upper cabinet
2 Furniture body
3 Top flap
4 Side wall
5 Side wall
6 Bottom panel
7 Top panel
8 Rear wall
9 Top flap fitting
10 Fitting unit

11 Fitting unit
12 Base unit
13 Swivel arm assembly
13*a* Adjusting arm
14 Cover plate
15 Mounting unit
16 Spring-force unit
17 Adjusting unit
18 Locking mechanism
19 Releasing element

The invention claimed is:

1. A device for moving a furniture flap received on a furniture body of a piece of furniture having a spring-force unit, which assists the opening and/or the closing of the furniture flap by a predetermined force action of the spring-force unit via an adjusting arm engaging with the furniture flap in the mounted state, wherein an electrically switchable adjusting unit is provided, which is coupled to the spring-force unit in such a way that a movement of the spring-force unit into a predetermined adjustment position of the spring-force unit on the piece of furniture occurs by a switching of the adjusting unit in the mounted state of the device so that a degree of force action of the spring-force unit on the furniture flap can be adjusted in dependence on the adjustment position of the spring-force unit.

2. The device as claimed in claim 1, wherein the electrically switchable adjusting unit comprises an electric drive.

3. The device as claimed in claim 1, wherein a first force application site of the spring-force unit is adapted for an attachment on the furniture body and a second force application site of the spring-force unit is adapted for an attachment on the furniture flap side, wherein the adjusting unit is provided for changing the distance between the first force application site of the spring-force unit and the second force application site of the spring-force unit.

4. The device as claimed in claim 1, wherein the adjusting unit is provided for changing the position of the first force application site of the spring-force unit.

5. The device as claimed in claim 1, wherein the spring-force unit can be moved with the adjusting unit into at least two different adjustment positions.

6. The device as claimed in claim 1, wherein the adjusting unit is designed to reversibly move the spring-force unit with the adjusting unit into at least two different adjustment positions.

7. The device as claimed in claim 1, wherein the adjusting unit is adapted to move the first force application site of the spring-force unit in a direction away from the second force application site of the spring-force unit.

8. The device as claimed in claim 1, wherein the adjusting unit is adapted to operate a locking mechanism for the locking of the furniture flap in the closed position on the furniture body.

9. The device as claimed in claim 1, wherein the spring-force unit comprises a spring-force pack with a spring-force accumulator.

10. A piece of furniture having a device as claimed in claim 1.

11. The device as claimed in claim 1, wherein the spring pack includes a plurality of springs arranged in parallel with respect to one another.

* * * * *